US008159399B2

(12) United States Patent
Dorsey et al.

(10) Patent No.: US 8,159,399 B2
(45) Date of Patent: Apr. 17, 2012

(54) ANTENNA DIVERSITY SYSTEMS FOR PORTABLE ELECTRONIC DEVICES

(75) Inventors: John G. Dorsey, San Francisco, CA (US); Douglas B. Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 894 days.

(21) Appl. No.: 12/132,549

(22) Filed: Jun. 3, 2008

(65) Prior Publication Data

US 2009/0295648 A1 Dec. 3, 2009

(51) Int. Cl.
*H01Q 1/24* (2006.01)

(52) U.S. Cl. ..... 343/702; 343/876; 455/101; 455/575.7

(58) Field of Classification Search ..... 343/876, 343/702, 893; 455/101, 575.7
See application file for complete search history.

(56) References Cited

U.S. PATENT DOCUMENTS 5,463,406 A 10/1995 Vannatta et al.
5,905,467 A 5/1999 Narayanaswamy et al.
6,285,893 B1 * 9/2001 Keirinbou ..... 455/575.7
6,456,856 B1 * 9/2002 Werling et al. ..... 455/575.5
6,862,433 B2 * 3/2005 Callaway, Jr. ..... 455/101
6,959,209 B2 * 10/2005 Fang ..... 455/571
6,978,121 B1 12/2005 Lane et al.
2005/0090288 A1 * 4/2005 Stohr et al. ..... 455/566
2005/0124305 A1 * 6/2005 Stichelbout ..... 455/117
2006/0161871 A1 7/2006 Hotelling et al.
2006/0205368 A1 * 9/2006 Bustamante et al. ..... 455/101
2006/0232468 A1 10/2006 Parker et al.

OTHER PUBLICATIONS

U.S. Appl. No. 12/061,159, filed Apr. 2, 2008, Ligtenberg et al.
U.S. Appl. No. 11/969,684, filed Jan. 4, 2008, Schlub et al.

* cited by examiner

*Primary Examiner* — Dieu H Duong
(74) *Attorney, Agent, or Firm* — Treyz Law Group; David C. Kellogg; G. Victor Treyz

(57) ABSTRACT

Antenna diversity systems are provided for portable electronic devices that have wireless communications circuitry and environment sensors. The wireless communications circuitry may include multiple redundant antennas that operate in one or more overlapping radio-frequency communications bands. The environment sensors and redundant antennas may be used in implementing an antenna diversity system. For example, an electronic device may use environment sensors to select an antenna for use in handling wireless communications. The electronic devices may monitor the wireless performance of an active antenna. When the wireless performance of the active antenna degrades, the electronic devices may select a new antenna for wireless communications using the antenna diversity system and environment sensors. Antenna selection may also be made based on which features are being used in the electronic device.

10 Claims, 9 Drawing Sheets

| BLUETOOTH CONNECTION TO HEADSET | APPLICATION RUNNING | AMBIENT LIGHT SENSOR | TEMPERATURE SENSOR | ORIENTATION SENSOR | HEADSET PROXIMITY SENSOR | PROBABLE USAGE MODE OR LOCATION | ACTION (I.E., SELECTED ANTENNA) |
|---|---|---|---|---|---|---|---|
| OFF | TELEPHONE APPLICATION NOT RUNNING | DARK | WARM | N/A | AN OBJECT IS CLOSE | IN POCKET | USE UPPERMOST ANTENNA |
| OFF | TELEPHONE APPLICATION RUNNING | N/A | WARM | N/A | AN OBJECT IS CLOSE | HANDSET MODE (I.E., AGAINST USER'S HEAD) | USE LOWER ANTENNA (AWAY FROM USER'S HEAD) |
| OFF | TELEPHONE APPLICATION NOT RUNNING | N/A | N/A | PORTRAIT AND DISPLAY FACING UP | NO OBJECTS ARE CLOSE | PDA MODE | USE UPPERMOST ANTENNA |
| ON | N/A | N/A | N/A | N/A | N/A | BLUETOOTH ACTIVE | UPPER AND LOWER ANTENNAS USED FOR WLAN AND BLUETOOTH, RESPECTIVELY |
| N/A | N/A | N/A | N/A | LEVEL | NO OBJECTS ARE CLOSE | DEVICE RESTING ON TABLE | SELECT ANTENNA BASED ON RADIATION PATTERN |

FIG. 9

ANTENNA DIVERSITY SYSTEMS FOR PORTABLE ELECTRONIC DEVICES

BACKGROUND

This invention relates generally to antenna diversity systems, and more particularly, to antenna diversity systems for portable electronic devices.

Portable electronic devices such as handheld electronic devices are becoming increasingly popular. Examples of handheld devices include handheld computers, cellular telephones, media players, and hybrid devices that include the functionality of multiple devices of this type. Popular portable electronic devices that are somewhat larger than traditional handheld electronic devices include laptop computers and tablet computers.

Due in part to their mobile nature, portable electronic devices are often provided with wireless communications capabilities. For example, portable electronic devices may use long-range wireless communications to communicate with wireless base stations. Cellular telephones and other devices with cellular capabilities may communicate using cellular telephone bands at 850 MHz, 900 MHz, 1800 MHz, and 1900 MHz. Portable electronic devices may also use short-range wireless communications links. For example, portable electronic devices may communicate using the Wi-Fi® (IEEE 802.11) bands at 2.4 GHz and 5.0 GHz and the Bluetooth® band at 2.4 GHz. Data communications are also possible at 2100 MHz and the unlicensed 60 GHz band (57-66 GHz).

A number of compromises are typically made when designing antennas for a portable electronic device. For example, antennas that protrude excessively from a device housing may be unsightly. Antennas that are located within a device housing may be more desirable from an esthetic point of view, but can be challenging to design. Internal antennas are sometimes subject to proximity effects that make antenna performance dependent on the position of objects (such as a user's body) relative to the antenna.

Electronic devices that have redundant antennas (e.g., two or more antennas that operate in similar radio-frequency bands) may use diversity schemes to improve the reliability and performance of wireless communications activities. Traditional diversity schemes involve monitoring the strength or quality of signals that are received from multiple antennas in real time. If an antenna's performance drops below a given threshold, another antenna may be used for wireless communications activities. Antenna diversity schemes of this type may offer superior performance to arrangements that rely solely on a single antenna. However, waiting for antenna performance to degrade before making antenna adjustments can lead to undesirable dropped signals.

It would therefore be desirable to be able to provide improved antenna diversity systems.

SUMMARY

Antenna diversity systems are provided for portable electronic devices. The antenna diversity systems may use proximity sensors or other environment sensors to improve the wireless communications performance of portable electronic devices that operate in rapidly changing environments. The portable electronic devices may have wireless communications circuitry that includes transceiver circuitry, two or more antennas that operate in identical or similar radio-frequency communications bands, and circuitry for coupling a desired one of the antennas to the transceiver circuitry. The environment sensors may include any suitable sensors such as proximity sensors, ambient light sensors, accelerometers or other orientation sensors, touch sensors, thermal sensors, combinations of such sensors, etc.

The antenna diversity systems may use information from environment sensors and information from application software to determine which of the antennas is most likely to have satisfactory performance for wireless communications activities. For example, in an electronic device with an orientation sensor, a diversity system may be able to determine whether the electronic device is upright or upside down and then select the antenna that is facing upwards. In another arrangement, in an electronic device with multiple redundant antennas each of which is co-located with a respective proximity sensor, a diversity system may use information from the proximity sensors to determine which antennas have external objects nearby that may obstruct wireless signals and may then select an antenna that does not have an external object nearby. With one suitable arrangement, in an electronic device configured to operate as a cellular telephone, a diversity system may use information from application software indicating that a telephone call is in progress to select the antenna that is most likely to be away from a user's head (e.g., an antenna located away from an ear speaker of the electronic device).

Antenna diversity systems in electronic devices with environment sensors may also monitor the performance of an active antenna and switch to another antenna when the active antenna's performance drops below a threshold. For example, after an antenna has been selected using information from environment sensors or application software, an antenna diversity system may monitor the signal strength of incoming wireless signals on the active antenna and may switch to another antenna if the signal strength drops to an unacceptable level.

Further features of the invention, its nature and various advantages will be more apparent from the accompanying drawings and the following detailed description of the preferred embodiments.

BRIEF DESCRIPTION OF THE DRAWINGS

FIG. 9 is a table that shows illustrative antenna selections that may be made in an antenna diversity system in an electronic device using information from non-radiofrequency-based sources in accordance with an embodiment of the present invention.

DETAILED DESCRIPTION

The present invention relates generally to antenna diversity systems, and more particularly, to antenna diversity systems for electronic devices. The electronic devices may be portable electronic devices such as laptop computers, tablet computers (e.g., slate-shaped portable electronic devices), or small portable computers of the type that are sometimes referred to as ultraportables. Portable electronic devices may also be somewhat smaller devices.

The electronic devices may be, for example, handheld wireless devices such as cellular telephones, media players with wireless communications capabilities, handheld computers (also sometimes called personal digital assistants), remote controllers, global positioning system (GPS) devices, and handheld gaming devices. The electronic devices may also be hybrid devices that combine the functionality of multiple conventional devices. Examples of hybrid portable electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. These are merely illustrative examples.

Figure 1:
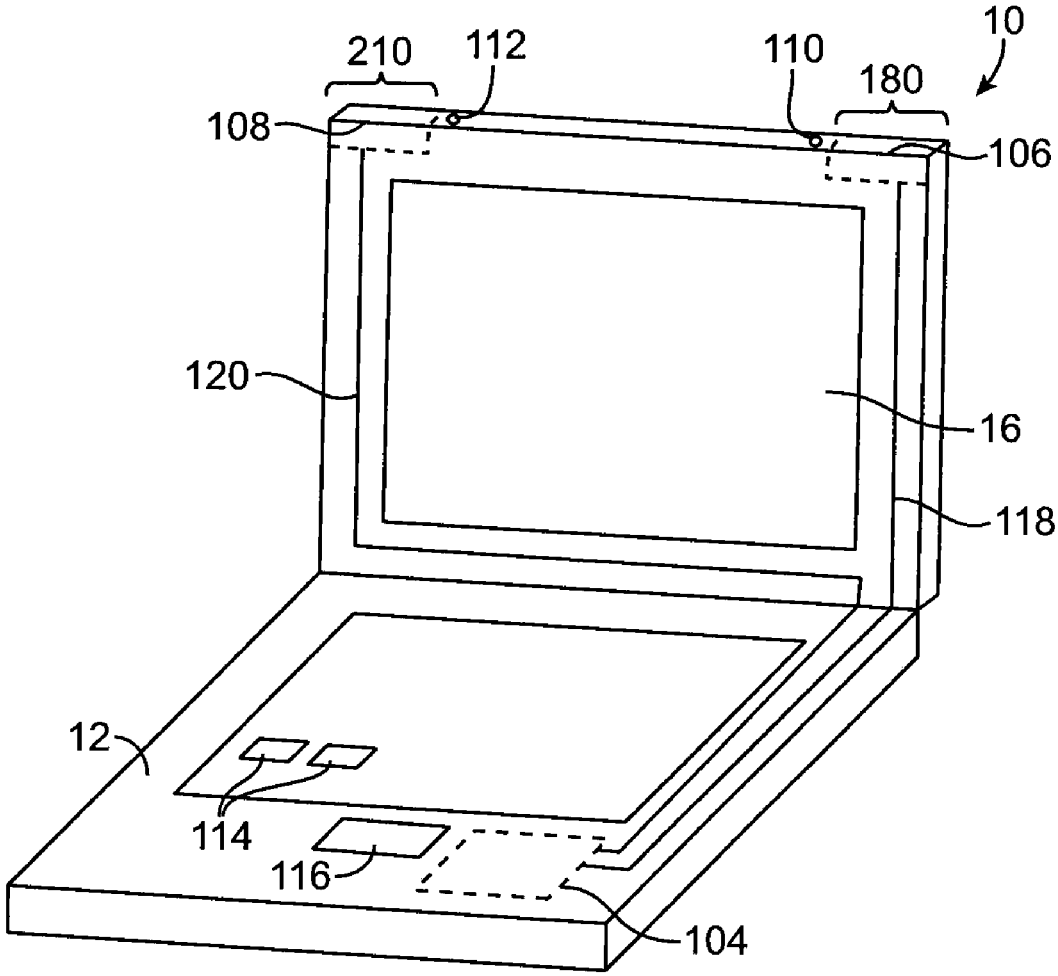
FIG. 1 is a perspective view of an illustrative portable electronic device that may be used to implement an antenna diversity system in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

Device 10 may handle communications over one or more communications bands. Typical communications bands that may be handled by the wireless communications circuitry in device 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, the 2G and 3G cellular telephone bands (e.g., 850 MHz, 900 MHz, 1800 MHz, 1900 MHz, and 2100 MHz), the licensed WiMAX® bands (e.g., 2.3 GHz, 2.5 GHz, and 3.5 GHz), and the unlicensed 60 GHz band (e.g., the 57-64 GHz band in the United States and the 59-66 GHz band in Europe and Japan). These bands may be covered by using single and multiband antennas. For example, cellular telephone communications can be handled using multiband cellular telephone antennas and local data communications can be handled using multiband wireless local area network antennas.

Device 10 has housing 12. Housing 12, which is sometimes referred to as a case, may be formed of any suitable materials including plastic, glass, ceramics, metal, other suitable materials, or a combination of these materials. In some situations, housing 12 or portions of housing 12 may be formed from a dielectric or other low-conductivity material, so as not to disturb the operation of conductive antenna elements that are located in proximity to housing 12.

Housing 12 or portions of housing 12 may also be formed from conductive materials such as metal. An illustrative metal housing material that can be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements can be used as part of the antennas in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10).

Device 10 may have one or more keys such as keys 114. Keys 114 can be formed on any suitable surface of device 10. In the example of FIG. 1, keys 114 have been formed on the top surface of device 10. With one suitable arrangement, keys 114 form a keyboard on a laptop computer. Keys such as keys 114 may also be referred to as buttons.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality can be integrated into display 16 (e.g., using a capacitive touch sensor). Device 10 may also have a separate touch pad device such as touch pad 116. An advantage of integrating a touch screen into display 16 to make display 16 touch sensitive is that this type of arrangement can save space and reduce visual clutter. If desired, a touch screen integrated into display 16 to make display 16 touch sensitive may function as a proximity sensor in addition to functioning as a touch sensor (e.g., so that display 16 can detect objects that are in close proximity to display 16 but are not actually touching display 16). Keys 114 may, if desired, be arranged adjacent to display 16. With this type of arrangement, the buttons may be aligned with on-screen options that are presented on display 16. A user may press a desired button to select a corresponding one of the displayed options.

Device 10 includes circuitry 104. Circuitry 104 may include storage, processing circuitry, antenna switching circuitry, and input-output components. Wireless transceiver circuitry in circuitry 104 may be used to transmit and receive radio-frequency (RF) signals. Transmission lines (e.g., communications paths) such as coaxial transmission lines and microstrip transmission lines are used to convey radio-frequency signals between transceiver circuitry and antenna structures in device 10. As shown in FIG. 1, for example, transmission lines 118 and 120 are used to convey signals between circuitry 104 and antenna structures 106 and 108, respectively. Communications paths 118 and 120 (i.e., transmission lines 118 and 120) can be, for example, coaxial cables that are connected between an RF transceiver (sometimes called a radio) and multiband antennas.

Antenna structures such as antenna structures 106 and 108 may be located in regions 180 and 210, respectively, (e.g., at opposite ends of a top edge of an upper portion of housing 12) as shown in FIG. 1 or in other suitable locations. For example, antenna structures such as antenna structures 106 and 108 can be located on another housing edge or on another surface of housing 12 (e.g., on the surface of keys 114).

Device 10 may have multiple antennas that are each used to cover the same communications band or bands. For example, two pentaband cellular telephone antennas may be provided at opposing ends of the top edge of device 10 (e.g., in regions 180 and 210) or two dual band (2.4 GHz/5 GHz) GPS/Bluetooth®/IEEE-802.11 antennas may be provided at opposing ends of the top edge of device 10 (e.g., in regions 180 and 210). Device 10 may also have one or more antennas that do not overlap in their coverage of communications bands (e.g., antennas that are not used in a diversity arrangement). For example, device 10 may have two similar dual band GPS/Bluetooth®/IEEE-802.11 antennas (e.g., one in region 180 and one in region 210) while only having one pentaband cellular telephone antenna in region 180 or in region 210. These are merely illustrative arrangements. Any suitable antenna structures may be used in device 10 if desired.

Device 10 may have environment sensors such as orientation sensors (e.g., acceleration sensors), proximity sensors (e.g., sensors that emit infrared light and detect when this emitted light is reflected back to device 10), ambient light sensors, temperature sensors, etc. Acceleration sensors such as orientation sensors may be used to measure the orientation of device 10 relative to a horizontal plane (e.g., relative to the ground). The environment sensors may be located in any suitable portion of device 10 such as near the antennas of device 10. User input devices such as touchpad 116, keys 114, and touch screen display 16 may, if desired, serve as environment sensors, because activity from these devices typically indicates the presence of an external object such as a user's finger. When device 10 has multiple antennas that overlap in their coverage of radio-frequency bands, environment sensors in device 10 may be used in determining which antenna is most likely to be suitably positioned for successful wireless communications.

As one example, device 10 may have sensors such as sensor 112 (located near antenna 108) and sensor 110 (located near antenna 106) that detect when objects are near antennas such as antennas 106 and 108 during operation of device 10. Sensors 110 and 112 are shown as being located on a top edge of housing 12 in device 10 of FIG. 1. This is merely illustrative. Sensors such as sensors 110 and 112 may be placed at any suitable location in device 10. For example, sensors such as sensors 110 and 112 may be located on an inside edge of device 10 near regions 180 and 210, respectively. Sensors 110 and 112 may be based on any suitable type of sensor such as a proximity sensor, a thermal sensor, a light sensor, etc. Thermal sensors may include thermal sensors based on thermocouples, diodes, and any other suitable sensor technologies. With one suitable arrangement, sensors 110 and 112 may each be formed from a light source such as a light emitting diode that emits infrared light and a photodetector such as a photodiode that detects infrared light. In this type of arrangement, when an object comes into proximity with a proximity sensor such as sensor 110 or sensor 112, the emitted infrared light may reflect off of the object and be detected by the light detecting diode.

With one arrangement, when device 10 has two similar antennas, one in region 180 and one in region 210, device 10 may use sensors such as sensors 110 and 112 to determine which of the two antennas is more likely to be suitable for wireless communications activities. When device 10 determines that an object is near region 180, device 10 may switch to using the antenna in region 210 for wireless communications, because the antenna in region 180 is likely to have reduced performance due to the proximity of the object and its potential to block radio-frequency signals.

Figure 2:
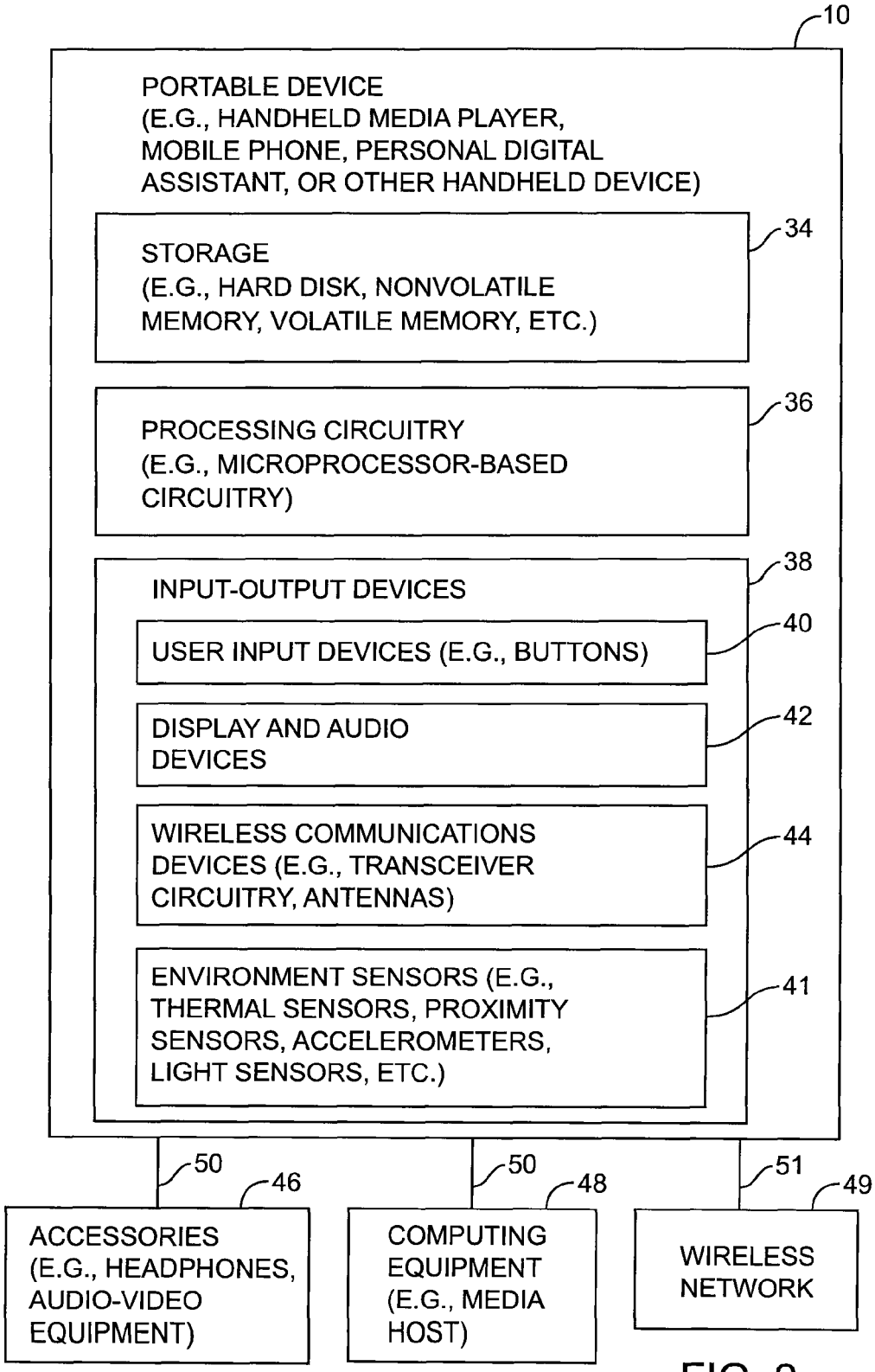
FIG. 2 is a schematic diagram of an illustrative portable electronic device that may be used to implement an antenna diversity system in accordance with an embodiment of the present invention.

A schematic diagram of an illustrative portable electronic device such as a handheld electronic device that may be used to implement an antenna diversity system is shown in FIG. 2. Portable device 10 may be a laptop computer, a table computer, mobile telephone, a mobile telephone with media player capabilities, a handheld computer, a remote control, a game player, a global positioning system (GPS) device, an ultraportable computer, a hybrid device that includes the functionality of some or all of these devices, or any other suitable portable electronic device.

As shown in FIG. 2, device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as antenna diversity applications, internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G communications services (e.g., using wide band code division multiple access techniques), 2G cellular telephone communications protocols, WiMAX® communications protocols, communications protocols for the unlicensed 60 GHz band, etc.

Input-output devices 38 may be used to allow data to be supplied to device 10 and to allow data to be provided from device 10 to external devices. Display screen 16, keys 114, and touch pad 116 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications).

Environment sensors 41 can include sensors such as acceleration sensors (e.g., accelerometers and other orientation sensors), proximity sensors, thermal sensors, light sensors, etc. If desired, proximity sensors may be based on a light emitting diode and a corresponding light detecting diode that detects emitted light from the light emitting diode that is reflected back towards device 10 from nearby objects. User input devices 40 may also be used as environment sensors 41. For example, buttons and touch-screen input devices may be used as proximity detectors for detecting the presence of an object. Environment sensors 41 (and processing circuitry 36) may be used in implementing an antenna diversity system in device 10. For example, sensors 41 may be used to help determine which antenna in device 10 would be most likely to have satisfactory radio-frequency performance in a given situation.

Device 10 can communicate with external devices such as accessories 46, computing equipment 48, and wireless network 49 as shown by paths 50 and 51. Paths 50 may include wired and wireless paths. Path 51 may be a wireless path. Accessories 46 may include headphones (e.g., a wireless cellular headset or audio headphones), audio-video equipment (e.g., wireless speakers, a game controller, or other equipment that receives and plays audio and video content), a peripheral such as a wireless printer or camera, etc.

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

Wireless network 49 may include any suitable network equipment, such as cellular telephone base stations, cellular towers, wireless data networks, computers associated with wireless networks, etc. For example, wireless network 49 may include network management equipment that monitors the wireless signal strength of the wireless handsets (cellular telephones, handheld computing devices, etc.) that are in communication with network 49.

The antenna structures and wireless communications devices of device 10 may support communications over any suitable wireless communications bands. For example, wireless communications devices 44 may be used to cover communications frequency bands such as cellular telephone voice and data bands at 850 MHz, 900 MHz, 1800 MHz, 1900 MHz, and 2100 MHz (as examples). Devices 44 may also be used to handle the Wi-Fi® (IEEE 802.11) bands at 2.4 GHz and 5.0 GHz (also sometimes referred to as wireless local area network or WLAN bands), the Bluetooth® band at 2.4 GHz, the licensed WiMAX® bands at 2.3 GHz, 2.5 GHz, and 3.5 GHz, and the unlicensed 60 GHz band (e.g., the 57-64 GHz band in the United States and the 59-66 GHz band in Europe and Japan), and the global positioning system (GPS) band at 1575 MHz.

Figure 3:
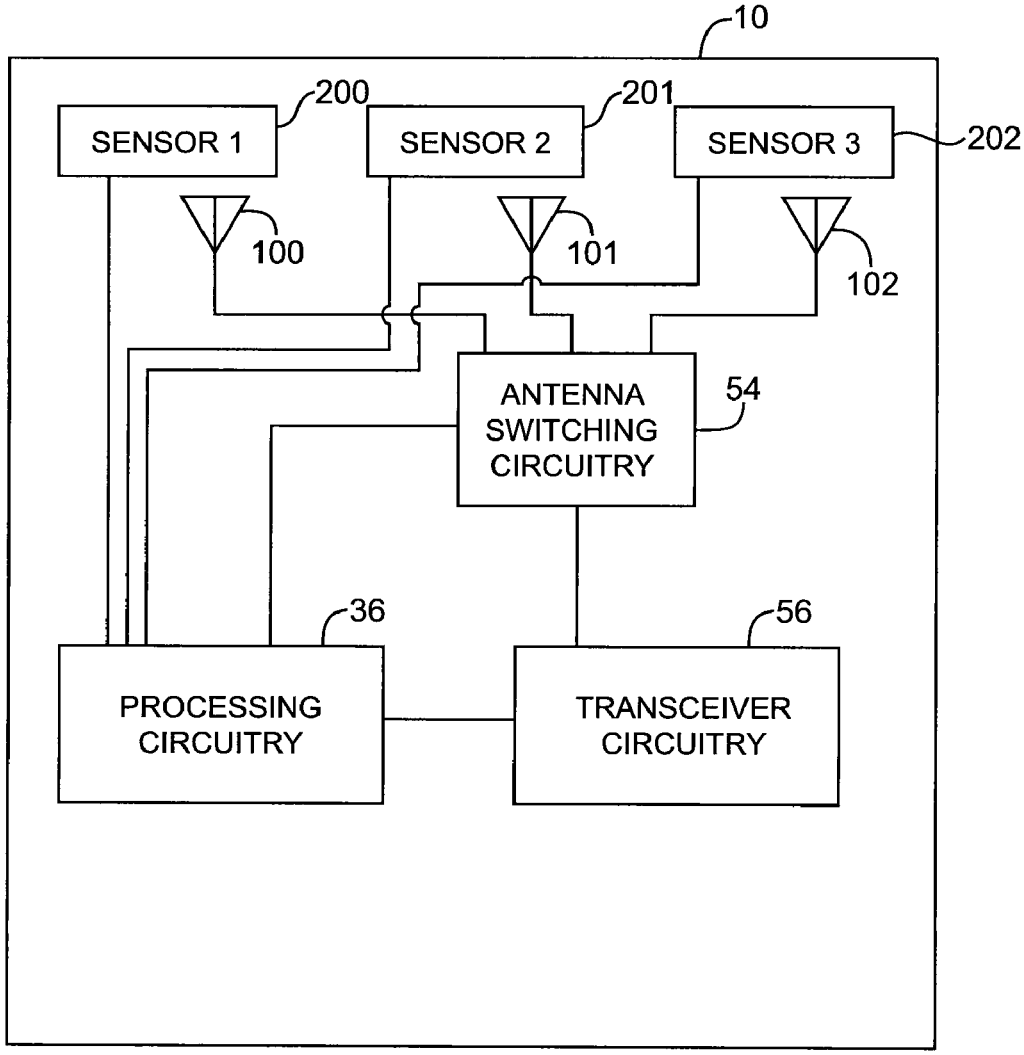
FIG. 3 is a circuit diagram of an illustrative electronic device that has multiple antennas and antenna switching circuitry and that may be used to implement an antenna diversity system in accordance with an embodiment of the present invention.

As shown in FIG. 3, device 10 may implement an antenna diversity system in which the device switches between multiple antennas to optimize wireless communications performance. If desired, device 10 may have multiple antennas such as antennas 100, 101, and 102 that cover similar radio-frequency bands, sensors such as sensors 200, 201, and 202 (e.g., environment sensors 41), and processing circuitry 36 for use in selecting which antenna in device 10 would be most likely to have satisfactory radio-frequency performance (e.g., by monitoring the environment around device 10). Antenna switching circuitry 54 may be used to electrically couple the selected antenna (e.g., one of antennas 100, 101, or 102) to transceiver circuitry 56. With another suitable arrangement, transceiver circuitry 56 may be directly connected to multiple antennas and may itself perform switching operations (e.g., antenna switching circuitry 54 may be integrated into transceiver circuitry 56). If desired, device 10 may have multiple antenna switching circuits 54, multiple transceivers 56, and multiple sets of antennas (e.g., in embodiments in which device 10 has multiple antenna diversity systems).

Each antenna 100, 101, and 102 may be implemented using a single antenna or an array of antennas. For example, one or more of antennas 100, 101, and 102 may be formed from multiple antenna elements that make up an electronically steerable antenna array. If desired, one or more of antennas 100, 101, and 102 may include an antenna array used in supporting IEEE 802.11n wireless communications (e.g., in supporting multiple-input multiple-output, or MIMO, schemes). In single antenna and antenna array arrangements multiple antenna structures may be combined to provide extended frequency coverage. For example, each of antennas 100, 101, and 102 may be formed from two or more antenna structure that are used together to provide multi-band radio-frequency communications capabilities.

Sensors such as sensors 200, 201, and 202 may be located at any suitable location in device 10. With one suitable arrangement, sensors 200, 201, and 202 are located near (e.g., within millimeters or centimeters) to antennas 100, 101, and 102, respectively. For example, each sensor 200, 201, and 202 may be a proximity sensor such as a thermal sensor or a light sensor that is located adjacent to a particular antenna and that is used in detecting the presence of objects that could interfere with the operation of that particular antenna (e.g., one of antennas 100, 101, or 102). Sensors 200, 201, and 202 may also be formed from a portion or all of a touch screen input device such as touch screen display 16. As an example, in the FIG. 1 embodiment, touch screen display 16 may be used by device 10 to determine when an object (e.g., a user's hand) is in the vicinity of a particular antenna (e.g., an antenna in region 180 or region 210).

If desired, sensors such as sensors 200, 201, and 202 may also include sensors that are not associated directly with a particular antenna but that are used to sense information about the general environment around device 10. For example, one or more of sensors 200, 201, and 202 (or another environment sensor 41) may be an orientation sensor that is used in determining whether device 10 is in a right side up or upside down position, whether device is lying on a table (e.g., relatively flat and immobile), whether device 10 is in a position that may indicate that the device is being used for a particular activity (e.g., such as when device 10 is a device sometimes referred to as a personal digital assistant and is being held in the hand of a user), etc.

Transceiver circuitry 56 may also be used in an antenna diversity system (e.g., to select one of antennas 100, 101, or 102 for use in wireless communications). For example, transceiver circuitry 56 may analyze the radio-frequency signals that are received by device 10 to gather information on current radio-frequency communication conditions. Transceiver 56 may determine the strength of incoming radio-frequency signals and may determine error rates for incoming data for each antenna in device 10. If desired, transceiver 56 may determine the strength of incoming and outgoing RF signals using any suitable method such as by using error-checking codes that are applied to incoming packet and frame payloads and by observing whether or not proper acknowledgment messages are received by transceiver 56 in response to packets transmitted by device 10. Transceiver 56 may gather information on RF conditions by measuring reflections from the radio-frequency signals that transceiver 56 has generated (e.g., because an object near the active antenna has reflected transmitted signals back towards an active antenna such as one of antennas 100, 101, or 102). Information from transceiver circuitry 56 on current radio-frequency communication conditions may be conveyed to processing circuitry 36 to use in antenna selection (e.g., in the device's antenna diversity system).

Processing circuitry 36 may use information from environment sensors such as sensors 200, 201, and 202, from user input devices 40, from transceiver circuitry 56 (such as information on the current signal strength of incoming radio-frequency signals), from software running on device 10 (i.e., on processing circuitry 36), and information from other suitable sources to select which antenna (i.e., antenna 100, 101, or 102) is to be used for radio-frequency communications activities. Processing circuitry 36 may generate and convey control signals to antenna switching circuitry 54 that direct the switching circuitry to couple the selected antenna to transceiver circuitry 56. If desired, antenna switching circuitry 54 may be integrated with transceiver circuitry 56 into a single integrated circuit (e.g., a single chip).

Figure 4:
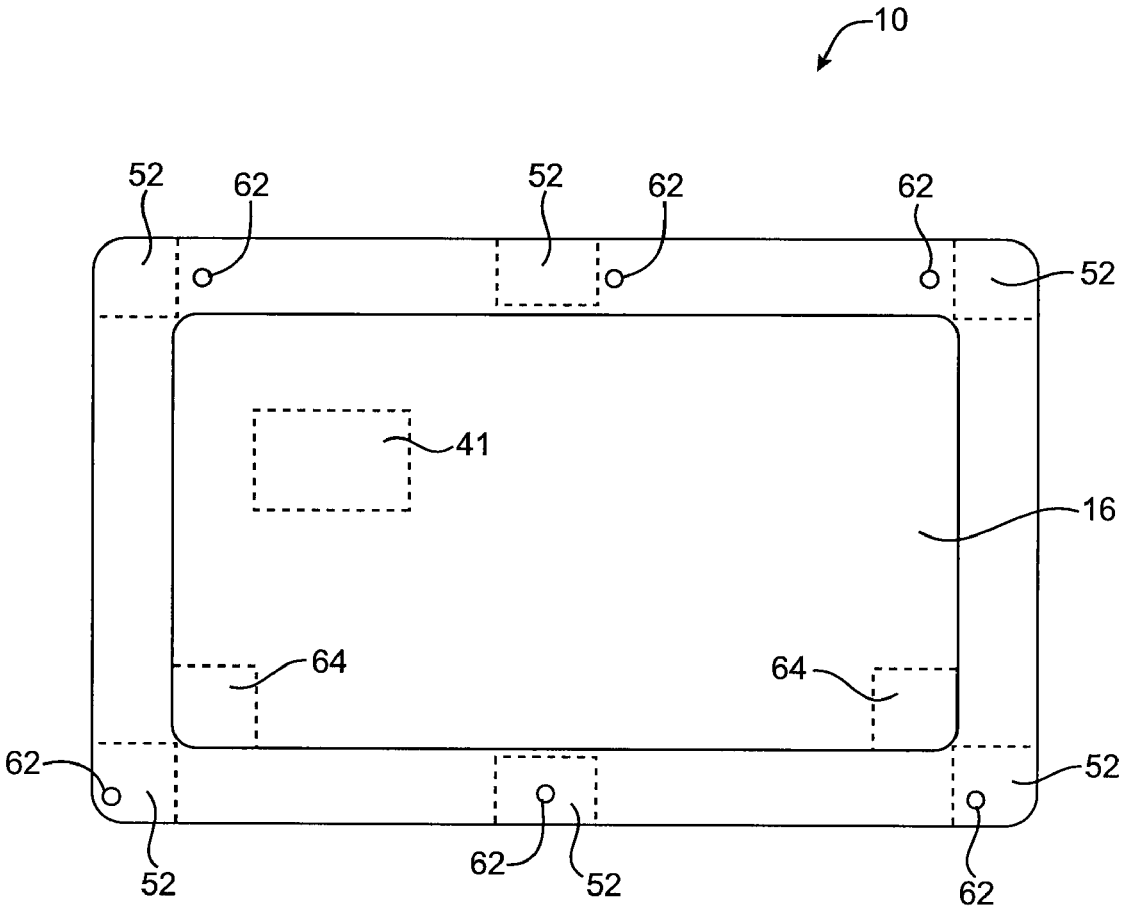
FIG. 4 is a top view of an illustrative portable electronic device that has multiple antennas and environment sensors and that may be used to implement an antenna diversity system in accordance with an embodiment of the present invention.

As shown in FIG. 4, device 10 may be a compact electronic device such as a tablet computer (e.g., a slate-shaped portable electronic device). Device 10 of FIG. 4 may implement an antenna diversity system with multiple antennas 52, sensors 62 (e.g., proximity sensors), portions 64 of a touch screen display such as display 16 that are used to detect objects (such as a user's hand), and environment sensors such as sensor 41 (which are generally located within a device housing). In general, device 10 may have any suitable number of antennas 52, sensors 62, portions 64, and sensors 41.

In the FIG. 4 embodiment, sensor 41 may be an orientation sensor that is used to determine the position of device 10. For example, sensor 41 may be an accelerometer capable of determining the direction of gravity relative to device 10 (e.g., whether the device is being held upright, is lying flat on a table, or is in another orientation with respect to the ground). An orientation sensor such as sensor 41 may be used to determine which antenna 52 in device 10 is pointing upwards and may therefore exhibit improved radio-frequency performance relative to the performance of antennas pointing towards the ground.

Any suitable number of antennas 52, sensors 62, and portions 64 may be provided in device 10. In general, a device that has a larger number of antennas is more likely to have at least one antenna with satisfactory radio-frequency communications performance. If desired, each antenna 52 can have an associated sensor 62 that detects the presence of an object in the vicinity of its associated antenna 52. Portions 64 of touch screen display 16 may be used in place of sensors 62 or in addition to sensors 62 to determine when an object is in proximity to a particular antenna.

Figure 5:
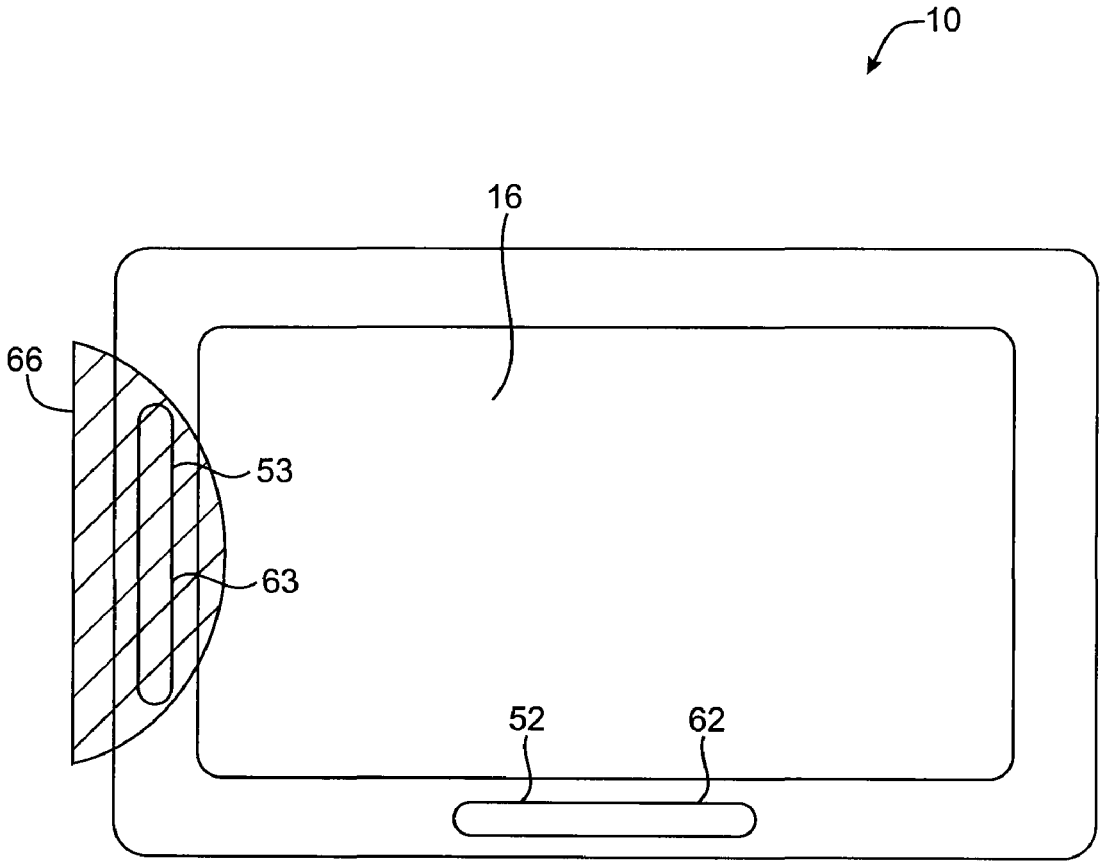
FIG. 5 is a top view showing an illustrative portable electronic device with multiple antennas that may be used to implement an antenna diversity system and showing an object that may cover one of the device's antennas in accordance with an embodiment of the present invention.

FIG. 5 shows how an electronic device such as device 10 that has two antennas such as antenna 52 and antenna 53 may use an antenna diversity system based on non-radio-frequency sensors such as proximity sensor 62 and proximity sensor 63.

In the FIG. 5 example, when one of the sensors (e.g., sensor 63 under object 66) or a portion of touch screen display 16 near antenna 53 detects the presence of an object that may interfere with radio-frequency communications such as object 66 (e.g., a user's hand), device 10 may switch to using a different antenna (e.g., antenna 52) for wireless communications.

By switching to an unobstructed antenna such as antenna 52 using information from sensors 62 and 63 rather than waiting for radio-frequency communications with antenna 53 to fail, the wireless communications performance of device 10 may be improved. In contrast, with traditional antenna diversity methods, an electronic device would not switch antennas until radio-frequency communications had already degraded, which could result in a disruption of wireless communications activities.

Figure 6:
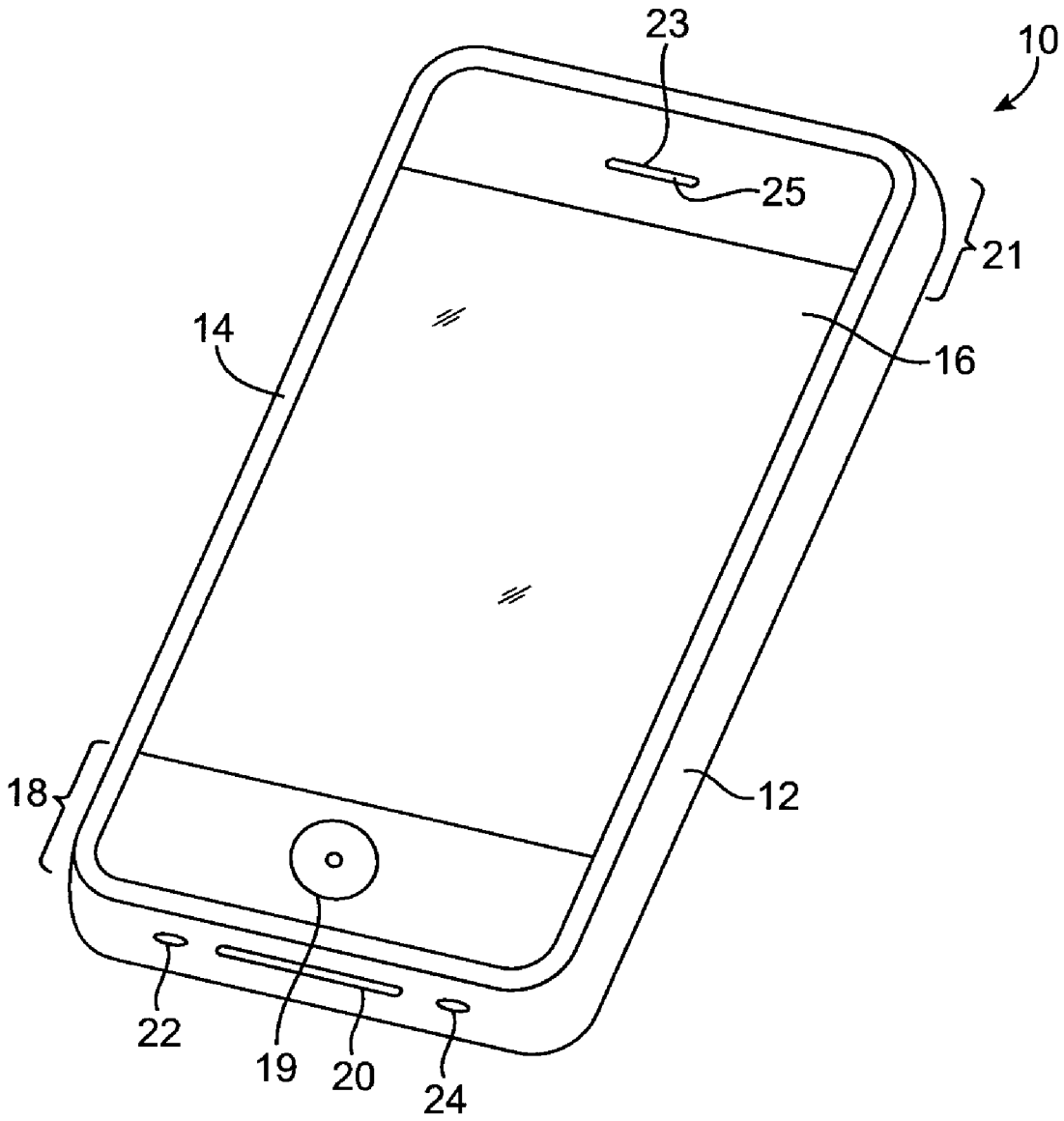
FIG. 6 is a perspective view of an illustrative handheld portable electronic device that may be used to implement an antenna diversity system in accordance with an embodiment of the present invention.

An illustrative handheld electronic device in accordance with an embodiment of the present invention is shown in FIG. 6. Device 10 of FIG. 6 may be, for example, a handheld electronic device that supports 2G and/or 3G cellular telephone and data functions, global positioning system capabilities, and local wireless communications capabilities (e.g., IEEE 802.11 and Bluetooth®) and that supports handheld computing device functions such as internet browsing, email and calendar functions, games, music player functionality, etc.

Housing 12 may have a bezel 14 that surrounds the top of display 16. Display screen 16 may be a touch screen with a capacitive touch sensor that accepts user touch and multi-touch commands. If desired, electronic device 10 may have other input-output devices. For example, electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 22 and 24 may, if desired, form speaker and microphone ports. Speaker port 22 may be used when operating device 10 in speakerphone mode. Opening 23 may also form a speaker port. For example, speaker port 23 may serve as a telephone receiver that is placed adjacent to a user's ear during operation. In the example of FIG. 6, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

Examples of locations in which antenna structures may be located in device 10 include region 18 and region 21. These are merely illustrative examples. Any suitable portion of device 10 may be used to house antenna structures for device 10 if desired.

Any suitable antenna structures may be used in device 10. For example, device 10 may use antenna structures formed from one or more single antennas (single-band or multiband), one or more antenna arrays (e.g., single-band or multi-band), beam-forming antenna arrays such as steerable beam-forming antenna arrays (sometimes referred to as beamsteering antennas or beamsteering arrays), other directional antennas, sectorized antennas, etc. Device 10 may have multiple antennas that are used to cover a single communications band or multiple antennas each of which may cover multiple communications bands. In one embodiment, two pentaband cellular telephone antennas may be provided at opposing ends of device 10 (e.g., in regions 18 and 21). Two dual band GPS/Bluetooth®/IEEE-802.11 antennas may be also be provided at opposing ends of device 10 (e.g., in regions 18 and 21). Device 10 may also have one or more antennas that do not overlap in their coverage of communications bands (e.g., antennas that are not used in a diversity system). For example, device 10 may have two short range 2.4 GHz antennas (e.g., one in region 18 and one in region 21) while only having one cellular telephone antenna in region 18 or in region 21. These are merely illustrative arrangements. Any suitable antenna structures may be used in device 10.

As one example, device 10 may have a sensor such as sensor 25 located near or within speaker port 23 that detects when an object such as a user's ear is close to port 23 during operation of device 10. Sensor 25 may be based on any suitable sensor such as a proximity sensor, a thermal sensor, a light sensor, etc. Thermal sensors may be based on thermocouples, diodes, and any other suitable sensor technologies. With one suitable arrangement, sensor 25 may be a proximity sensor formed from a light emitting diode that emits infrared light and a light detecting diode that detects the infrared light. In this type of arrangement, when an object such as a user's ear comes into proximity with sensor 25, the emitted infrared light may reflect off of the object and be detected by the light detecting diode.

If device 10 has two similar antennas, one in region 18 and one in region 21, device 10 may use sensor 25 to determine which of the two antennas is more likely to be suitable for wireless communications activities. In this example, when device 10 determines that the user's ear is near port 23, device 10 may switch to using the antenna in region 18 for wireless communications since the antenna in region 21 is likely to have reduced performance due to the proximity of the user's head. This type of arrangement may also reduce the amount of radio-frequency radiation that is produced by device 10 in close proximity to the user's head.

Figure 7:
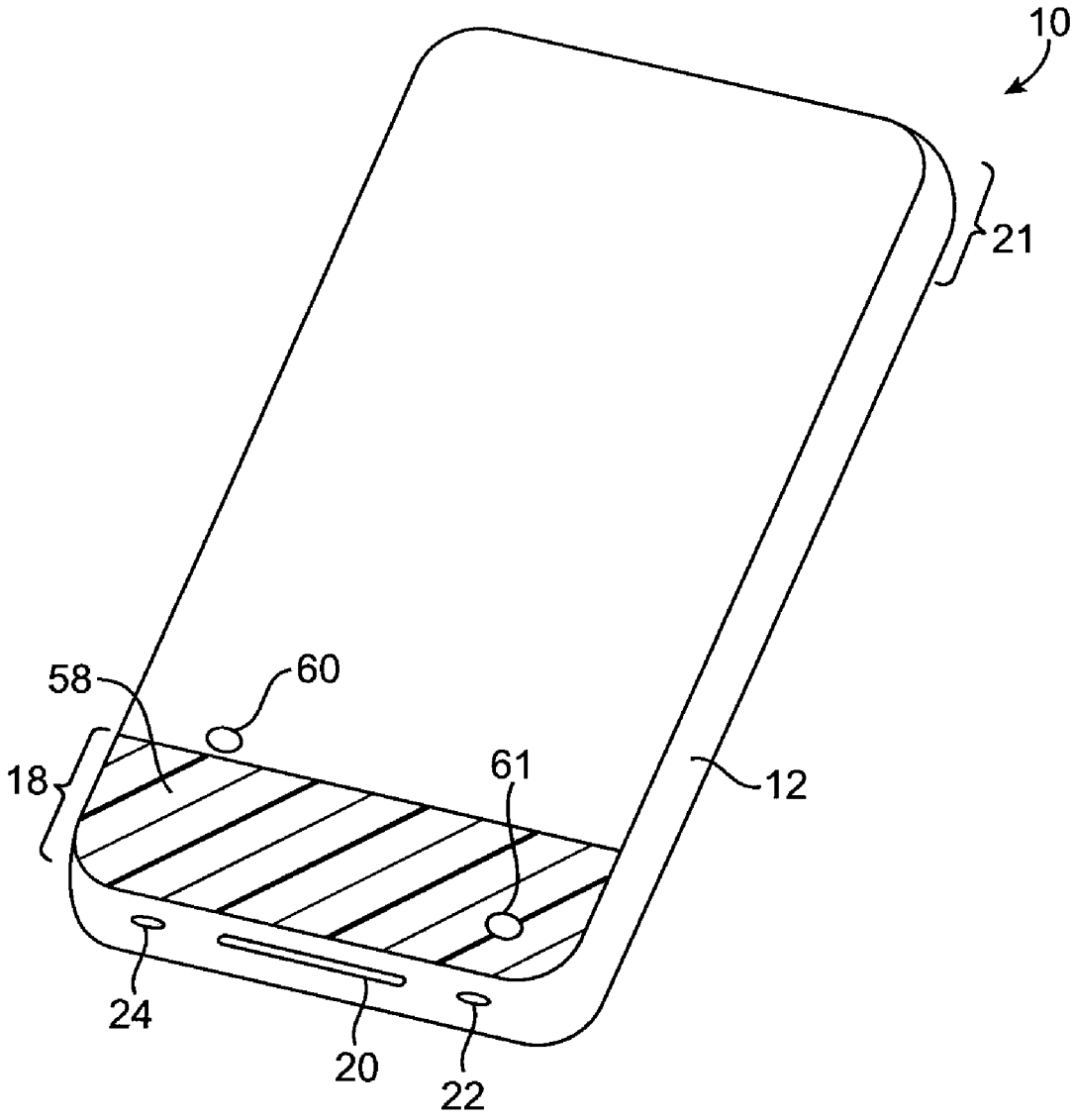
FIG. 7 is a perspective view of the back side of the portable electronic device in FIG. 6 in accordance with an embodiment of the present invention.

A view of the back side (rear) of the electronic device shown in FIG. 6 is shown in FIG. 7. Device 10 may have antennas in region 18 and region 21. The antennas in region 18 and region 21 may transmit and receive radio-frequency signals through dielectric portions (e.g., dielectric windows) in housing 12 such as dielectric window 58. Dielectric window 58 may allow radio-frequency signals for the antenna in region 18 to pass through the backside of the electronic device. Dielectric window 58 may be formed from any suitable dielectric materials. Dielectric window 58 may also be formed from materials that are similar in appearance to surrounding portions of housing 12 such that dielectric window 58 blends in to the surrounding portions (and may therefore be less visible to a user).

Sensors such as sensors 60 and 61 may be located on the backside of device 10 in or near region 18 (e.g., near the antennas located in region 18). If desired, device 10 may be provided with either sensor 60 or sensor 61 or may have both sensors 60 and 61. Sensors 60 and 61 may be proximity sensors used by device 10 to detect when an object is in the vicinity of region 18 and therefore likely to interfere with radio-frequency communications. For example, sensors 60 and 61 may detect when device 10 is resting right side up on a table or when device 10 is being held by a user with the user's hand covering antenna window 58. A similar arrangement may be used for the antenna in region 21.

When device 10 is resting right side up on a table, dielectric window 58 may be blocked by the table. A sensor such as sensor 60 or sensor 61 may detect this condition. In response, device 10 may switch antennas in region 21 into use for wireless communications (e.g., antennas in region 21 may be used to send and receive radio-frequency signals through the top or front side of device 10).

Figure 8:
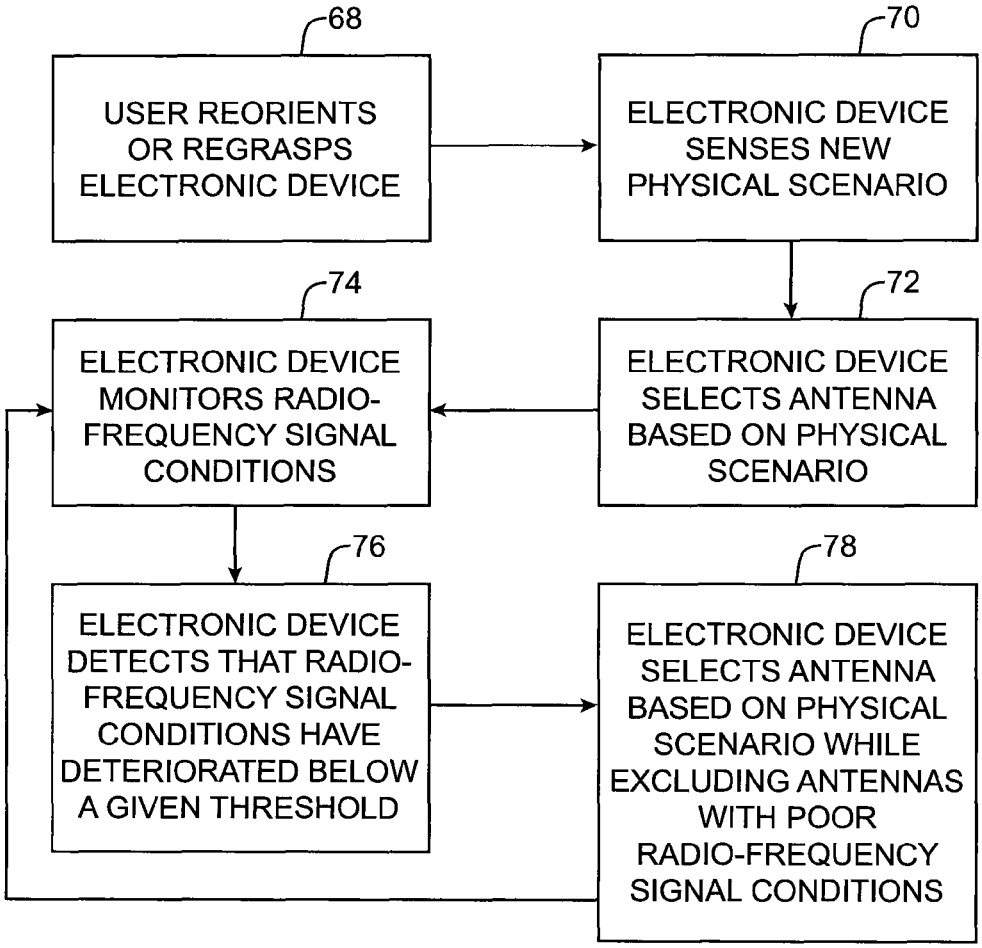
FIG. 8 is a flow chart of illustrative steps involved in using signals from environment sensors and radio-frequency signal conditions in an antenna diversity system in an electronic device to choose an antenna to perform wireless communications activities in accordance with an embodiment of the present invention.

FIG. 8 is a flow chart of illustrative steps involved in using an antenna diversity system for an electronic device such as device 10 that has multiple antennas and environment sensors such as proximity sensors and orientation sensors.

At step 68, a user of device 10 may reorient (i.e., reposition) device 10, grasp device 10 in a different manner, or otherwise alter the physical environment around device 10. Examples of reorienting device 10 include situations in which a user picks device 10 up from a table, a user raises device 10 to their ear, a user shifts device 10 between landscape and portrait orientations, a user places device 10 right side up or upside down onto a table, a user opens or closes device 10 (e.g., when device 10 is suitable device such as a laptop computer with pivoting housing portions), etc.

At step 70, the change in the physical environment around device 10 that arose during step 68 may be detected by environment sensors such as sensors 41 which may include portions of touch screen display 16. For example, a proximity sensor may detect that an object has come into or left the vicinity of the electronic devices (e.g., by detecting body heat, by detecting a change in ambient or reflected light, by detecting changing electrical properties in a proximity sensor induced by nearby objects such as capacitance changes, etc.). An orientation sensor may detect when device 10 has been reoriented. Data from multiple sensors may be used to detect more complex changes in the physical environment surrounding device 10. For example, when thermal sensors detect an increase in ambient temperature, light sensors detect a drop in the intensity of ambient light, and proximity sensors detect nearby objects all at the same time, device 10 may be able to determine within a certain probability that the device has been placed into a user's pocket.

At step 72, device 10 may switch a particular antenna (such as one of antennas 52) into use in handling wireless communications activities based on the inputs of environment sensors 41. For example, device 10 may opt to use the antenna that is farthest from external objects (such as a user's hand) or an antenna that is facing upwards. Device 10 may select an antenna that maximizes the likelihood that wireless communications activities will be successful (i.e., that signals will be received with sufficient signal strength).

In general, device 10 may choose which antenna to use based on information from applications that are running on device 10, from accessories 46, from user input devices 40, from environment sensors such as sensors 41, etc. For example, in a device 10 that has cellular telephone functionality, device 10 may select an antenna based on whether or not the device is being used to make a cellular telephone call. Device 10 may also use information such as whether a speakerphone is being used or whether a Bluetooth® headset or wired headset is connected to the device and is being used (both of which may indicate that the device is not near a user's ear even if the device is being used to make a cellular telephone call). As an example when device 10 has cellular telephone functionality (e.g., in an arrangement of the type shown in FIG. 6), device 10 may choose to use an antenna in region 18 whenever the device is being used to make a cellular telephone call, so that the user's head is less likely to interfere with the antenna in region 18 (e.g., when a cellular telephone application is active and when speakerphone and headset devices are not being used). When the speakerphone or headset is being used, device 10 may use an antenna that is pointing upwards (e.g., such as the "top" antenna in region 21). Device 10 may determine which antenna is pointing upwards using information from an orientation sensor (i.e., an accelerometer).

By selecting an antenna in step 72 using information obtained from non-radio-frequency based sources, device 10 may exhibit improved wireless communication performance, particularly when device 10 is a highly mobile electronic device such as a cellular telephone handset or a portable computer. Because the radio-frequency conditions around highly mobile electronic devices can change frequently, waiting for radio-frequency conditions to degrade (as occurs in steps 74, 76, and 78) before switching antennas may be undesirable (e.g., because RF-based diversity systems typically take longer to respond to changing RF signal conditions). By proactively selecting antennas using non-RF based information (e.g., using information from environment sensors such as sensors 41 as in steps 70 and 72) before radio frequency conditions deteriorate, the overall wireless communications performance of device 10 may be improved.

Device 10 may perform steps 70 and 72 when initiating wireless communications activities. For example, when wireless communications are initiated, device 10 may use sensor data in selecting a particular antenna to use in a first attempt at connecting to a wireless network such as wireless network 51. Device 10 may use information from environment sensors (e.g., non-radio-frequency sensors). If desired, steps 70 and 72 may be repeated continuously during device operation to ensure proper antenna selection.

Whenever device 10 is performing wireless communications functions, the electronic device may also monitor radio-frequency signal conditions in real time (step 74). Device 10 may monitor RF signal conditions using any suitable method such as by measuring the strength (i.e., signal-to-noise ratio) of incoming wireless signals, by listening for reflections from transmitted wireless signals, by measuring error rates in incoming data, by observing the presence or absence of acknowledgement receipts returning from other wireless devices, etc.

As illustrated by step 76, device 10 may detect that radio-frequency signal conditions have degraded below a given threshold (such as when the signal-to-noise ratio of received signals drops to an unacceptable level). In response, the antenna diversity system implemented on device 10 may select another antenna (step 78).

During step 78, device 10 may select an optimum antenna to use in wireless communications activities. Because (in this example) device 10 is selecting a new antenna following the degradation of radio-frequency signal conditions (in step 76), device 10 may select an antenna in a similar manner to that of step 72 but may exclude from the selection those antennas that have a recent history of poor radio-frequency performance (i.e., that have had poor signal conditions). For example, if a given antenna selected in step 72 has insufficient radio-frequency performance, device 10 may exclude that antenna during its process of selecting a new antenna in step 78. When device 10 is attempting to connect to a new wireless network or reconnect to a wireless network, steps 74, 76, and 78 may be iteratively repeated either until wireless communications are successful or wireless communications have been attempted using all of the device's antennas. Steps 70 and 72 may also periodically be repeated if desired.

As illustrated in the table of FIG. 9, device 10 may select an antenna to use based on information from sensors and non-sensor sources. For example, device 10 may select an antenna using information from environment sensors 41 and user input devices 40, information from software running on device 10 (e.g., information on which applications or which portions of applications are active), information associated with the use of accessories 46 such as a Bluetooth® headset (e.g., whether there is an active wireless headset coupled to device 10), information from combinations of these and other sources, etc.

In the FIG. 9 example, device 10 might be a handheld electronic device of the type shown in FIGS. 6 and 7. For example, device 10 might be a handheld electronic device with two cellular telephone antennas at opposing ends of device 10 (e.g., in regions 18 and 21). Two 2.4 GHz antennas may be also be provided at opposing ends of device 10 (e.g., in regions 18 and 21). These are merely illustrative arrangements.

One possible situation that device 10 may be able to identify is illustrated in the first row of the table of FIG. 9. In this situation, device 10 may be placed in a user's pocket. When device 10 placed in a user's pocket, an ambient light sensor may sense that the surrounding environment is dark and a proximity sensor such as sensor 25 may detect that an object is nearby. Device 10 may use an orientation sensor to identify the uppermost antenna (i.e., the antenna in region 21 if device 10 is vertically upright) in device 10. This antenna may then be switched into use for wireless communications. If desired, when device 10 is a cellular telephone, device 10 may only opt to use an antenna in region 21 for wireless communications in situations in which a cellular telephone application is not presently running (e.g., in order to minimize the amount of radio-frequency radiation emitted in the vicinity of a user's head).

When device 10 is a cellular telephone device, device 10 may be held up against a user's ear and used during cellular telephone calls. As illustrated in the second row of the table of FIG. 9, device 10 may be able to recognize this situation using information from software and/or hardware that indicates that a cellular telephone call is being made. As an example, device 10 may use information from a headset proximity sensor (i.e., sensor 25) to determine when the device is being held against a user's ear during cellular telephone calls. In this situation, device 10 can use an antenna that is located away from the user's head such as an antenna in region 18.

Another situation that device 10 may be able to identify occurs when device 10 is held in a user's hand and is being used for activities other than cellular telephone activities. For illustrative purposes, this situation is referred to herein as a personal digital assistant (PDA) mode and is illustrated in the third row of the table of FIG. 9. In PDA mode, device 10 may not be running a telephone application, an orientation sensor may be indicating that the device is upright with its display facing up (e.g., in approximately the position illustrated in FIG. 6), and a headset proximity sensor such as sensor 25 may be indicating that no objects are close to the proximity sensor. When device 10 detects these conditions, device 10 may use its orientation sensor to identify the uppermost antenna (i.e., the antenna in region 21). The uppermost antenna may then be switched into use.

With one suitable arrangement, device 10 may be a handheld electronic device and may have two similar dual band GPS/IEEE-802.11 antennas (e.g., one in region 18 and one in region 21) while only having one dual band GPS/Bluetooth®/IEEE-802.11 antenna in region 18. In this type of arrangement, when the dual band GPS/Bluetooth®/IEEE-802.11 antenna in region 18 is active, it may be preferable to use the dual band GPS/IEEE-802.11 antenna in region 21 (rather than the similar antenna in region 18). The conditions of this situation are illustrated in the fourth row of the table of FIG. 9.

With another suitable arrangement, device 10 may have multiple antennas with varying radiation patterns. For example, in the FIG. 6 embodiment, device 10 may have antennas in regions 18 and 21 that transmit and receive wireless signals predominantly through the back and front faces of device 10, respectively (e.g., through the front surface shown in FIG. 6 and through the back surface shown in FIG. 7). In this arrangement, when device 10 has an orientation sensor and is placed on a flat surface (i.e., a table), device 10 may select an antenna based on radiation patterns. For example, when device 10 is placed on a table with its front face up, device 10 may select an antenna that at least partially radiates through its front face (e.g., an antenna in region 21). The conditions of this situation are illustrated in the last row of FIG. 9.

The foregoing is merely illustrative of the principles of this invention and various modifications can be made by those skilled in the art without departing from the scope and spirit of the invention.

What is claimed is:

1. A portable electronic device with wireless communications circuitry, comprising:

an accelerometer that determines an orientation of the portable electronic device relative to the direction of gravity;

a plurality of antennas that each transmit and receive radio-frequency signals in at least a first radio-frequency band;

a radio-frequency transceiver;

switching circuitry that selectively couples one of the plurality of antennas to the radio-frequency transceiver, wherein the plurality of antennas comprises a first antenna and a second antenna; and a proximity sensor that detects when an object comes within a given distance of the first antenna, wherein when the proximity sensor detects that an object has come within the given distance of the first antenna, the switching circuitry selectively couples the second antenna to the radio-frequency transceiver.

2. The portable electronic device defined in claim 1 wherein the switching circuitry comprises circuitry that selectively couples a given antenna in the plurality of antennas to the radio-frequency transceiver based at least partly on the orientation of the portable electronic device relative to the direction of gravity.

3. The portable electronic device defined in claim 1 further comprising:

processing circuitry that selectively couples a given antenna in the plurality of antennas to the radio-frequency transceiver based at least partly on signals from the orientation sensor that indicate which antennas out of the plurality of antennas are facing away from the direction of gravity.

4. The portable electronic device defined in claim 1 wherein the first antenna is located at one end of the portable electronic device and the second antenna is located at an opposite end of the portable electronic device.

5. The portable electronic device defined in claim 1 wherein when the proximity sensor has not detected that an object has come within the given distance of the first antenna, the switching circuitry selectively couples the first antenna to the radio-frequency transceiver.

6. The portable electronic device defined in claim 1 further comprising:

processing circuitry that uses signals from the orientation sensor that indicate the orientation of the portable electronic device to determine that a given antenna out of the first and second antennas is facing away from the direction of gravity, wherein when the proximity sensor does not detect that an object has come within the given distance of the first antenna, the given antenna is selectively coupled by the switching circuitry to the radio-frequency transceiver.

7. A portable electronic device comprising:

first and second antennas that each transmit and receive radio-frequency signals in at least a first radio-frequency band;

a first proximity sensor that is located adjacent to the first antenna and that detects objects relative to the first antenna;

a second proximity sensor that is located adjacent to the second antenna and that detects objects relative to the second antenna;

a radio-frequency transceiver; and switching circuitry that selectively couples a selected one of the first and second antennas to the radio-frequency transceiver, wherein the switching circuitry selectively couples the first to the radio-frequency transceiver whenever a given communications protocol is being used by the radio-frequency transceiver and wherein the switching circuitry selectively couples a selected one of the first and second antennas to the radio-frequency transceiver based on signals from the first and second proximity sensors whenever the given communications protocol is not being used by the radio-frequency transceiver.

8. The portable electronic device defined in claim 7 wherein each proximity sensor comprises a light emitting diode that emits light at an infrared frequency from the portable electronic device and a light detecting diode that detects light at the infrared frequency that has been reflected back to the portable electronic device.

9. The portable electronic device defined in claim 7 wherein the given communications protocol comprises a Bluetooth® communications protocol.

10. The portable electronic device defined in claim 7 wherein the first antenna is located at one end of the portable electronic device and the second antenna is located at an opposite end of the portable electronic device.

* * * * *

UNITED STATES PATENT AND TRADEMARK OFFICE

CERTIFICATE OF CORRECTION

PATENT NO. : 8,159,399 B2
APPLICATION NO. : 12/132549
DATED : April 17, 2012
INVENTOR(S) : John G. Dorsey and Douglas B. Kough It is certified that error appears in the above-identified patent and that said Letters Patent is hereby corrected as shown below:

In column 16, line 26, delete "couples the first to the radio-frequency transceiver" and insert -- couples the first antenna to the radio-frequency transceiver --

Signed and Sealed this
Nineteenth Day of March, 2013

Teresa Stanek Rea
*Acting Director of the United States Patent and Trademark Office*